United States Patent [19]

Speranza

[11] 4,180,881

[45] Jan. 1, 1980

[54] FOLDING TRANSPORTABLE BOAT

[76] Inventor: James L. Speranza, 7804 Ridge Rd., Gasport, N.Y. 14067

[21] Appl. No.: 869,957

[22] Filed: Jan. 16, 1978

[51] Int. Cl.[2] ..... B63B 7/02

[52] U.S. Cl. ..... 9/2 F; 9/6 P; 267/41

[58] Field of Search ..... 9/1.2, 6 P, 2 R, 2 F, 9/2 S; 267/41

[56] References Cited

U.S. PATENT DOCUMENTS

| | | | |
|---|---|---|---|
| 1,390,365 | 9/1921 | McKinley | 267/41 X |
| 3,090,973 | 5/1963 | Levinson | 9/1.2 |

*Primary Examiner*—Stephen G. Kunin
*Assistant Examiner*—Sherman D. Basinger
*Attorney, Agent, or Firm*—Ashlan F. Harlan, Jr.

[57] ABSTRACT

A folding boat comprising two sections, one of which may be folded back on the other for transportation, said boat being preferably formed by molding resin-impregnated fiberglass and including a frame embedded in the lower of the two folded sections and being provided with suspension means that comprises wheels mounted on leaf-springs and removably secured on opposite sides of the lower section of said boat whereby the folded boat may be towed by an automobile or other vehicle by a tow bar removably attached to the lower boat section.

8 Claims, 8 Drawing Figures

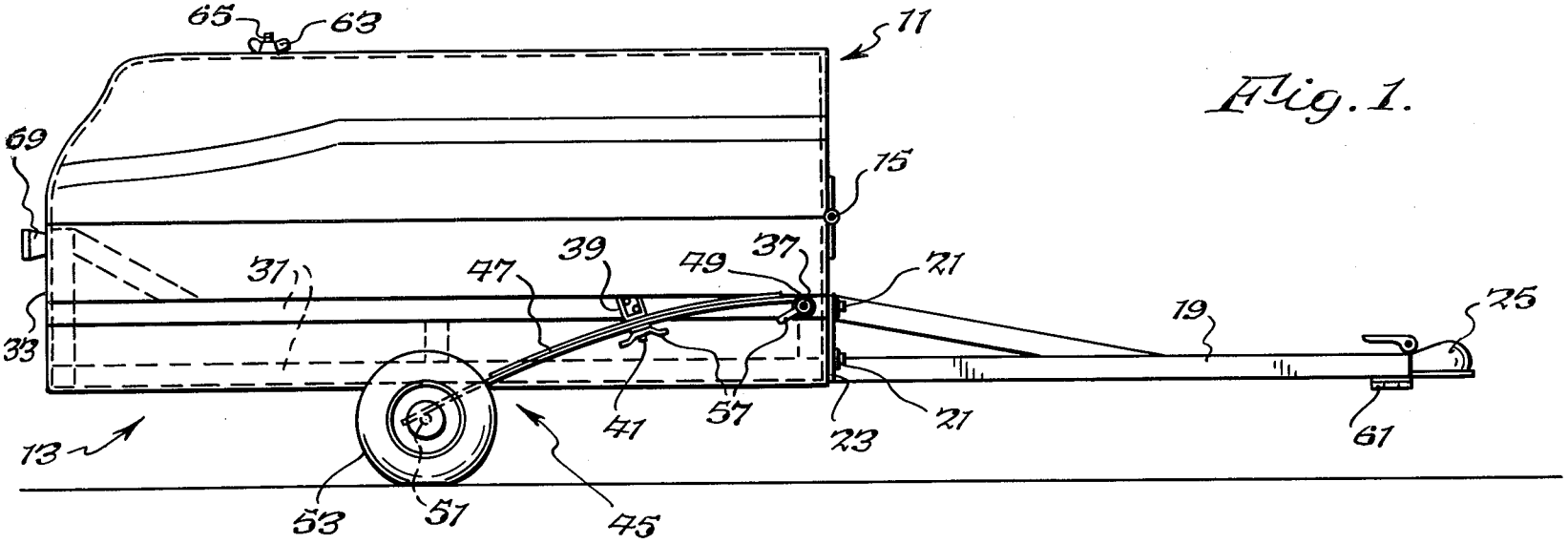
Fig. 1.
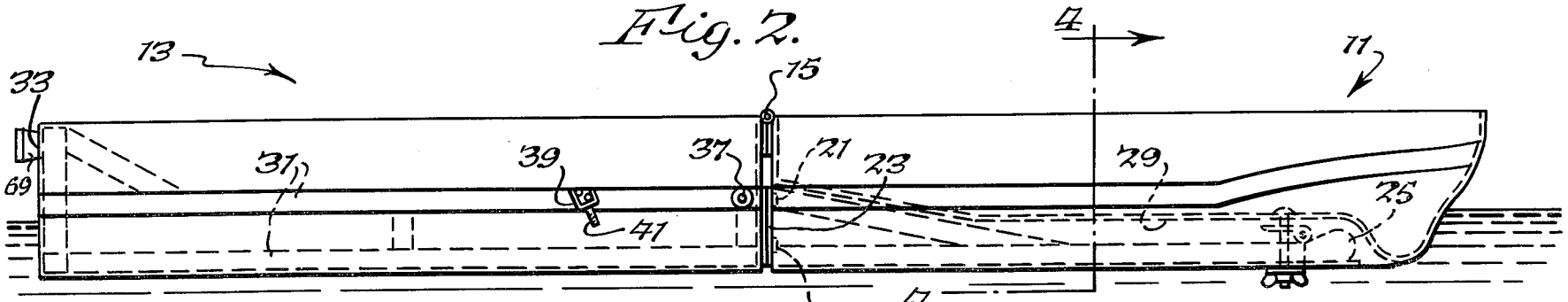
Fig. 2.
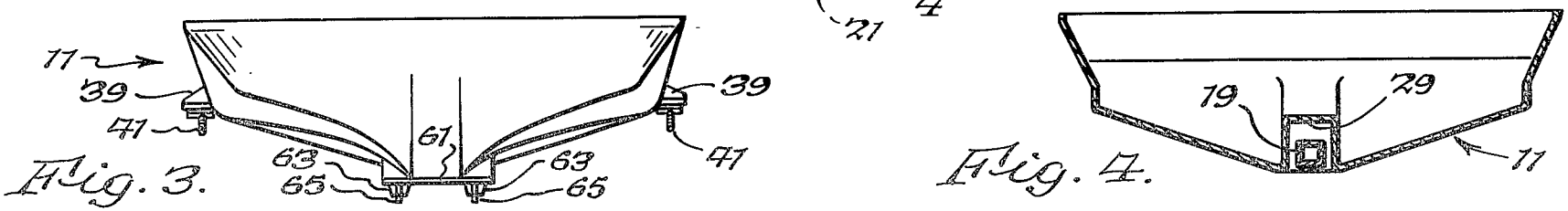
Fig. 4.
Fig. 3.

11
13
25
65
63
67
29
19
75
23
21
37
33
69

25
61
79
21
23
13
49
57
37
35
39
47
45
31
65
55
51
53
11
69

FOLDING TRANSPORTABLE BOAT

BACKGROUND OF THE INVENTION

The invention of the present application relates to boats and is particularly concerned with boats having means for folding and transporting them by towing.

In recent years boating has become very popular and many persons have become boat owners and users. Particularly attractive have been small, transportable boats that can be carried on the top of an automobile or on a trailer for towing by an automobile. These have permitted families on vacation to have a boat for fishing or other sports available at the vacation site and have permitted sportsmen to enjoy fishing in areas where there are no boats for hire. There have, however, been problems. Car top boats are often quite heavy and require more than one person to load and unload them. Similarly, it has often been a job requiring more than one person to launch a boat from a trailer and to reload the boat on the trailer after use. Accordingly, there has been interest in small boats that can be folded to give greater compactness and ease of handling and in the use of wheeled suspensions on boat hulls rather than mounting the hulls on separate trailers. Until the present, however, there have been problems and inconveniences, ranging from excessive cumbersomeness to excessive complication with resulting high cost, connected with the folding and directly suspended boats available. There has consequently been a need for a boat that- (a) can be operated in the same places as conventional car-top boats, but more easily;
(b) can be launched from a ramp by one person with no difficulty;
(c) can be used with moderate power outboard motors;
(d) can plane at high speeds;
(e) can be inexpensively produced using standard production methods;
(f) is easy and convenient to store; and
(g) provides weather-tight and lockable storage space for equipment.

SUMMARY OF THE INVENTION

The novel boat of the present invention comprises a bow section and a stern section, the sections being pivotally connected by hinges at their adjoining upper edges to permit the bow section to be folded back over the stern section. The boat sections are preferably formed of molded resin-impregnated fiberglass and a frame formed of welded metal tubing is embedded in and preferably covered by the resin-fiberglass material in the stern section. A tow bar or tongue is removably attached to the stern section to permit it to be readily towed by a suitably equipped vehicle on a pair of wheels removably carried on opposite sides of the stern section. Each of the wheels is secured at one end of a leaf spring. The spring is supported intermediate its ends on the stern section and the other end thereof is removably secured to the stern section.

SHORT DESCRIPTION OF THE DRAWINGS

FIG. 1 is a side view of the boat of the present invention folded and with wheels mounted thereon for towing;

FIG. 2 is a side view of the boat illustrated in FIG. 1 opened for use and with the wheels removed;

FIG. 3 is a front view of the boat as illustrated in FIG. 2;

FIG. 4 is a sectional view, taken on the line 4—4, of the boat as illustrated in FIG. 2;

DESCRIPTION OF THE ILLUSTRATED EMBODIMENT

It will be understood that many of the details hereinafter described of the illustrated embodiment of the invention are not critical. However, as now advised, it appears that the described and illustrated embodiment is over-all preferred.

As shown, the boat of the present invention comprises a forward or bow section 11 and a rear or stern section 13. These sections are pivotally connected by aligned hinges 15 joining the two sections along their adjoining upper edges whereby the sections can be folded together to make a closed compartment, as shown in FIG. 1, or opened out, as shown in FIG. 2 for use as a boat. When folded and provided with wheels, as shown in FIG. 1, the boat can be conveniently towed by a suitable vehicle (not shown) by means of the tow bar or tongue 19.

Figure 5:
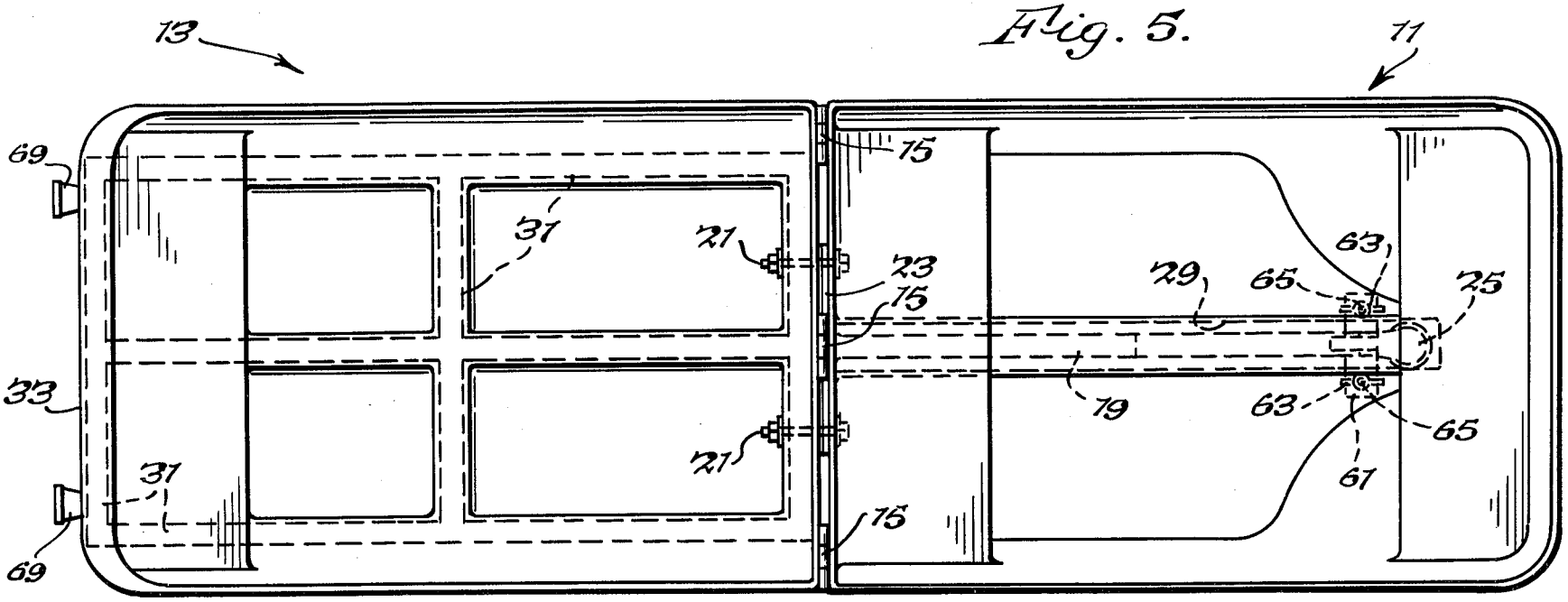
FIG. 5 is a top view of the boat as illustrated in FIG. 2.
Figure 6:
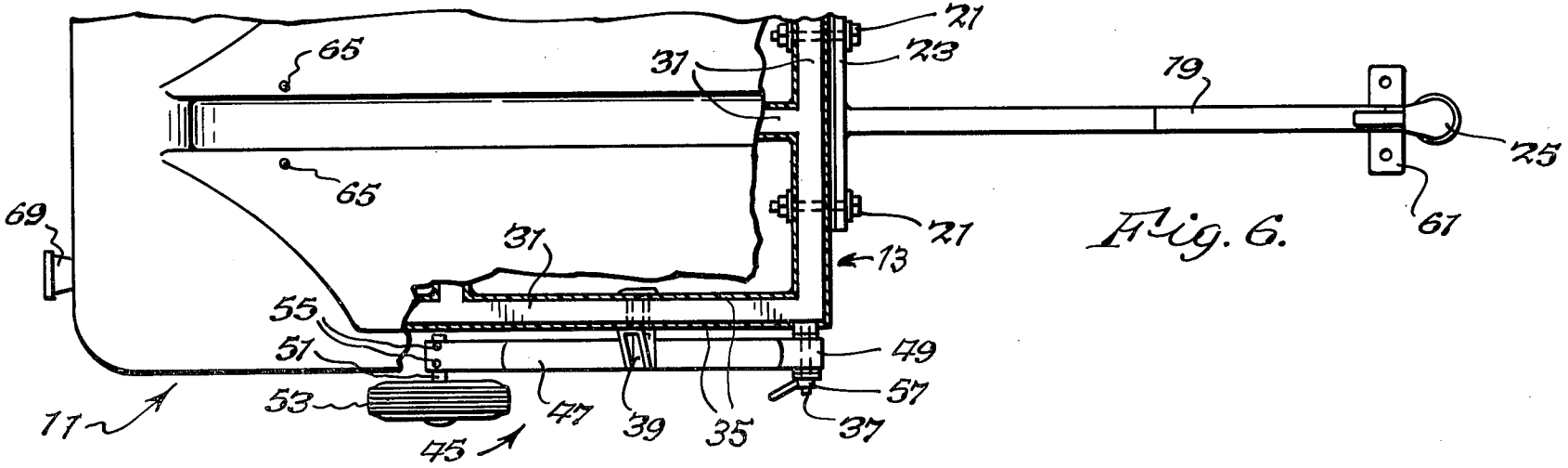
FIG. 6 is a fragmentary top view of the boat as illustrated in FIG. 1, with portions broken away.
Figure 8:
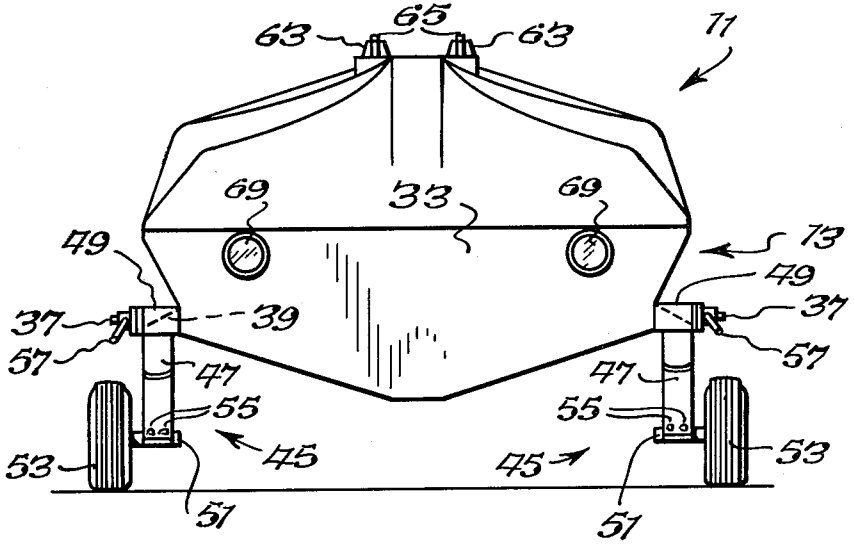
FIGS. 7 and 8 are front and rear views, respectively, of the boat with attached wheels, as illustrated in FIG. 1.
Figure 7:
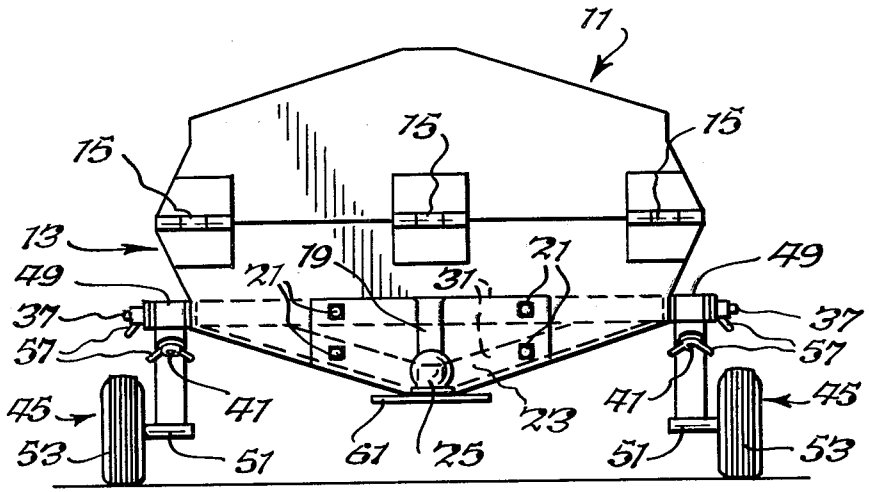

As shown in FIGS. 1, 6 and 7, the tow bar 19 comprises a substantially horizontal, braced member extending forwardly from the stern section 13 to which it is secured by bolts 21 that extend into the hull through a mounting plate 23 provided on the rear end of the tow bar. Suitable sealing gaskets and washers can be used in mounting the tow bar on the boat section 13 and, should it be removed, suitable plugs may be inserted in the holes for bolts 21. A cup 25 is provided on the free end of the tow bar 19 for fastening the latter to a trailer hitch of conventional type (not shown) on a towing vehicle (not shown). When the boat is opened out for use the tow bar 19 is received in and protected by a longitudinally extending recess 29 molded in the bottom of the front or forward boat section 11, as is clear from FIG. 2. This prevents a large projection on the outside of the hull of the boat that would interfere with planing.

The stern section 13 of the boat of the present invention is preferably reinforced by a built-in frame 31 as shown in FIGS. 1, 2, 5 and 6. It is to be noted that the frame 31 in FIG. 6 is shown in plan and not sectioned. The boat sections are conveniently constructed of molded resin impregnated fiberglass in accordance with conventional practices. Since the stern section is subjected to stresses from towing, from the carrying of loads, and from supporting an outboard motor when one is used, it is desirable to provide rigidity and strength therefor by a frame. The frame is rigid and preferably formed of metal tubing. It may be conveniently produced by welding together suitable lengths of tubing, preferably of aluminum, and the welded structure may then be pressed into a soft mass of fiberglass and resin in a suitable mold and covered by additional resin and fiberglass to form the boat section 13. The thus-formed inner and outer resin-fiberglass layers are denoted 35 in FIG. 6. The boat section 13 is not only strengthened by the frame 31, but is also made resistant to flexing of the transom 33 by the weight of a motor (not shown) supported thereon as well as resistant to flexing of its bottom and sides while floating or being transported.

The folding boat of the present invention is provided with easily installed and removed suspension means which comprise wheels and springs. On each side of the stern boat section 13 adjacent the front wall thereof there is provided a laterally extending threaded stud 37 suitably secured, e.g. by welding, to the metal frame 31 of the section. Also suitably secured to the frame 31, rearwardly of the studs 37, are outwardly projecting brackets 39, each of which carries a downwardly directed, threaded stud 41. The studs 37 and the studs 41 on the brackets 39 are adapted for mounting spring-wheel assemblies 45 on the stern section 13.

Each of the assemblies 45 comprises one or more leaf springs 47, one of which is provided with a loop or grommet 49, having an internal bushing, on one end and provided on the other end with a lateral stub shaft 51 having a wheel 53 rotatably mounted thereon. The wheels 53 are preferably of the type with pneumatic tires used for small trailers and the wheel shafts 51 are preferably non-rotatably secured to the springs 47 by bolts or rivets 55. The leaf springs 47 have elongated slots intermediate their ends to receive the downwardly directed studs 41 on the brackets 39. The springs are accordingly firmly held at their ends distant from the wheels and intermediate their ends so as to locate the wheels approximately under a transverse line passing through the center of gravity of the folded boat. Wing or finger nuts 57 are employed on the studs 37 and 41 for easy removal of the spring-wheel assemblies. Preferably the studs 37 and 41 are so placed that the wheels are provided with a small amount of positive camber when they are out of contact with the ground. Torsion of the springs 47 will cause this camber to be reduced when the wheels are subjected to the weight of the boat.

The present novel folding boat is extremely easy and convenient to use. With the boat folded as shown in FIG. 1 it may be towed by any convenient vehicle provided with a conventional trailer hitch to a beach or launching ramp. There the suspension means, i.e. the spring-wheel assemblies 45, are easily removed by supporting the sides of the folded boat so that the wheels 53 are off the ground. Then the nuts 57 are removed from the studs 37 and 41 and the assemblies 45 can be removed from the stern section 13 of the boat. If desired, however, the boat can be rolled into the water, and the assemblies 45 then removed. Indeed, in small bodies of water, where speed and planing of the boat are not important, the removal of the spring-wheel assemblies before use of the boat is not necessary.

Before or after the removal of the assemblies 45, the forward section 11 of the boat may be pivoted on the hinges 15 to the position shown in FIG. 2. To maintain the boat in opened position a plate 61 which is secured, as by welding, under the forward end of the tow bar 19 is removably fastened by thumb nuts 63 to studs 65 that are mounted in and project from the bow section 11 of the boat.

It will be understood that the general design of a folding boat constructed according to the present invention and many features thereof may vary from the showing in the accompanying drawings. Thus, for example only, the hull configuration can be changed, the seats shown can be eliminated or changed, the location of the tail lights 69 can be changed, a license plate bracket (not shown) can be provided, floatation compartments can be provided, and a locking arrangement can be provided to hold sections 11 and 13 in folded position, thus furnishing protection to equipment and supplies carried in the folded boat. It will be seen that the bow section 11 and stern section 13 have the same shape and size at their upper edges, thus allowing them to fit together when folded to form a closed compartment. It will be appreciated, however, that the boat may vary in size and that the ratio of length to width may also vary. Changes in boat size may require changes in the size of the wheels 15 and/or the springs 47. Further changes in the boat shape may require a change in the location of the suspension therefor.

Accordingly, it is further understood that the invention is not to be considered narrow and limited to the construction illustrated and described, but that it should be construed as broadly as permitted by the appended claims.

I claim:

1. A folding transportable boat comprising: a bow boat section and a stern boat section, said sections being hinged together whereby said bow section may be folded back over said stern section; said stern section being provided with an internal frame within the material forming said section; a tow bar adapted for use on a trailer hitch, said tow bar being removably attached to said frame and extending longitudinally forward from said stern section; and independent suspension means carried by said stern section on opposite outer sides thereof and readily removable therefrom, each of said suspension means comprising a rotatable wheel and a leaf spring, said spring having one end thereof attached to said wheel and the other end thereof removably attached to said frame; and means carried by said frame and projecting outwardly from said stern section removably supporting said spring s intermediate of their ends.

2. A folding transportable boat as defined in claim 1 wherein said boat sections are formed of molded resin-impregnated fiberglass and said frame is molded in said stern section of said boat.

3. A folding transportable boat as defined in claim 2 wherein said frame is formed of welded tubing.

4. A folding transportable boat as defined in claim 1 wherein said bow section is provided with a channel portion adapted to receive said tow bar when said boat is opened for use.

5. A folding transportable boat as defined in claim 4 wherein said boat sections are formed of molded resin-impregnated fiberglass and said frame is molded in said stern section of said boat.

6. A folding transportable boat as defined in claim 5 wherein said frame is formed of welded tubing.

7. A folding transportable boat as defined in claim 4 wherein said tow bar is accessible for use when said boat is opened.

8. A folding transportable boat as defined in claim 4 wherein said wheels are rotatably carried on axles attached to the ends of said springs.

* * * * *